US007559620B2

(12) United States Patent
Stephenson, III

(10) Patent No.: US 7,559,620 B2
(45) Date of Patent: Jul. 14, 2009

(54) PRINTHEAD ASSEMBLY HAVING REPLACEABLE PRINTHEAD

(75) Inventor: Stanley W. Stephenson, III, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 414 days.

(21) Appl. No.: 11/535,513

(22) Filed: Sep. 27, 2006

(65) Prior Publication Data

US 2008/0074465 A1 Mar. 27, 2008

(51) Int. Cl.
*B41J 2/015* (2006.01)

(52) U.S. Cl. ..... 347/20; 347/49

(58) Field of Classification Search ..... 347/12, 347/20, 40, 42, 49, 50, 56–59, 63, 65, 67, 347/84–87

See application file for complete search history.

(56) References Cited

U.S. PATENT DOCUMENTS

| | | | | |
|---|---|---|---|---|
| 4,791,440 | A | 12/1988 | Eldridge et al. | |
| 5,134,425 | A | 7/1992 | Yeung | |
| 5,548,311 | A | 8/1996 | Hine | |
| 6,068,367 | A | 5/2000 | Fabbri | |
| 6,367,903 | B1 | 4/2002 | Gast et al. | |
| 6,443,557 | B1 | 9/2002 | Pan | |
| 6,464,333 | B1 * | 10/2002 | Scheffelin et al. | 347/42 |
| 6,491,385 | B2 | 12/2002 | Anagnostopoulos et al. | |
| 6,722,759 | B2 | 4/2004 | Torgerson et al. | |
| 6,926,284 | B2 | 8/2005 | Hirst | |
| 6,969,158 | B2 | 11/2005 | Taira | |
| 7,185,968 | B2 * | 3/2007 | Kim et al. | 347/20 |
| 2005/0243130 | A1 | 11/2005 | Essen et al. | |

FOREIGN PATENT DOCUMENTS

| | | |
|---|---|---|
| EP | 1563999 | 8/2005 |

* cited by examiner

*Primary Examiner*—Juanita D Stephens
(74) *Attorney, Agent, or Firm*—William R. Zimmerli

(57) ABSTRACT

A print head assembly is provided. The printhead includes a substrate including a plurality of electrical contacts and an array of ejectors arranged on the substrate. Each ejector includes a chamber including a nozzle. A resistive element is associated with the chamber and is operable to eject liquid from the chamber through the nozzle of the chamber when actuated through the plurality of electrical contacts. At least one supply passage through the substrate supplies fluid to each ejector. A printhead holder includes a structure to retain the printhead in a fixed position and a manifold to supply fluid to each ejector through the at least one supply passage. A removable frame has a first position and a second position relative to the printhead holder. The frame includes a plurality of electrical contacts that provide an electrical connection to the plurality of electrical contacts on the substrate of the printhead when the frame is in the first position, and permits removal of the printhead from the retaining structure of the printhead holder when the frame is in the second position.

11 Claims, 7 Drawing Sheets

PRINTHEAD ASSEMBLY HAVING REPLACEABLE PRINTHEAD

CROSS REFERENCE TO RELATED APPLICATIONS

Reference is made to commonly-assigned, U.S. patent application Ser. Nos. 11/516,064 and 11/516,134, both filed Sep. 6, 2006, in the name of Stanley W. Stephenson, the disclosures of which are incorporated herein by reference.

FIELD OF THE INVENTION

This invention relates generally to the field of digitally controlled printing devices, and in particular to printhead assemblies that include replaceable printheads.

BACKGROUND OF THE INVENTION

Ink jet printing systems apply ink to a substrate. The inks are typically dyes and pigments in a fluid. The substrate can be comprised of an material or object. Most typically, the substrate is a flexible sheet that can be a paper, polymer or a composite of either type of material. The surface of the substrate and the ink are formulated to optimize the ink lay down.

Ink drops can be applied to the substrate by modulated deflection of a stream of ink (continuous) or by selective ejection from a drop generator (drop-on-demand). The drop-on-demand (DOD) systems eject ink using either a thermal pulse delivered by a resistor or a mechanical deflection of a cavity wall by a piezoelectric actuator. Ejection of the droplet is synchronized to motion of the substrate by a controller, which selectively applies an electrical signal to each ejector to form an image.

U.S. Pat. No. 6,491,385 to Anagnostopoulos et al., issued Dec. 10, 2002, entitled "CMOS/MEMS integrated ink jet print head with elongated bore and method of forming same," describes a continuous ink jet head and it's operation. A silicon substrate supports layers on the front surface having a pair of resistive elements. A bore through the silicon substrate is supplied for each nozzle. A fluid, which can be ink, is forcibly ejected through the bore and through a nozzle formed in the layers on the front surface. The resistors are modulated to break the stream of fluid into discrete droplets. Asymmetric heating of the resistors can selectively direct the droplets into different pathways. A gutter can be used to filter out select droplets, providing a stream of selectable droplets useful for printing. The modulated stream printing system requires significant additional apparatus to manage fluid flow.

Piezoelectric actuated heads use an electrically flexed membrane to pressurize a fluid-containing cavity. The membranes can be oriented in parallel or perpendicular to the ejection direction. U.S. Pat. No. 6,969,158 to Taira, issued Nov. 29, 2005, entitled "Ink-jet head," describes a piezoelectric drop-on-demand ink jet head having the membrane perpendicular to the droplet ejection direction. A set of plates is stacked up and includes plate of piezoelectric which flexes a pressure chamber parallel to the direction of ink ejection. The membranes require a large amount of surface area, and multiple rows of ejectors are arrayed in depth across the head. Ejectors are arranged across the printing direction at a pitch of 50 dpi and are arrayed in the printing direction 12 ejectors deep on an angle theta to form a head having an effective pitch of 600 dpi. Such heads are complex, requiring multiple layers that must be bonded together to form passages to the nozzle.

U.S. Pat. No. 6,926,284 to Hirst, issued Aug. 9, 2005, entitled "Sealing arrangements," discloses a drop-on-demand inkjet head permitting single-pass printing. A single pass print head comprises 12 linear array module assemblies that are attached to a common manifold/orifice plate assembly. Droplets are ejected from the orifice by twelve staggered linear array assemblies that support piezoelectric body assemblies to provide drop-on-demand ejection of ink through the orifice array. The piezoelectric system cannot pitch nozzles closely together; in the example, each swath module has a pitch of 50 dpi. The twelve array assemblies are necessary to provide 600 dpi resolution in a horizontally and vertically staggered fashion.

The orifice array on the plate can be a single two-dimensional array of orifices or a combination of orifices to form an array of nozzles. In the printing application, the orifices must be positioned such that the distance between orifices in adjacent line is at last an order of magnitude (more than ten times) the pitch between print lines. The assembly is quite complex, requiring many separate array assemblies to be attached to the orifice plate thorough the use of sub frames, stiffeners, clamp bar, washers and screws.

It would be advantageous to provide a staggered array in a unitary assembly with an integral orifice plate. It would be useful for the spacing between nozzles to be less than an order of magnitude deeper than is disclosed in this patent.

U.S. Pat. No. 6,722,759 to Torgerson et al., issued Apr. 20, 2004, entitled "Ink jet printhead," describes a common thermal drop-on-demand inkjet head structure. The drop generator consists of ink chamber, an inlet to the ink chamber, a nozzle to direct the drop out of the cavity and a resistive element for creating an ink ejecting bubble. Linear arrays of drop generators are positioned on either side of a common ink feed slot. Two linear arrays are fed by a common ink feed slot. Ink from the slot passes through a flow restricting ink channels to the ink chamber. A heater resistor at the bottom of the ink chamber is energized to form a bubble in the chamber and eject a drop of ink through a nozzle in the top of the chamber. The ejectors are constrained to be in linear rows on either side of the ink jet supply slot.

U.S. Pat. No. 6,367,903 to Gast et al., issued Apr. 9, 2002, entitled "Alignment of ink dots in an inkjet printer," discloses a similar structure. The arrays of drop generators are not in a strictly linear fashion, but are slightly offset in groups of three and four generators. Generators in a group are displaced sequentially farther from the supply slot within a group. Adjacent nozzles between the groups have a maximum variation in distance from the common supply slot.

U.S. Pat. No. 5,134,425 to Yeung, issued Jul. 28, 1992, entitled "Ohmic heating matrix," discloses a passive two-dimensional array of heater resistors. The structure and arrangement of the droplet generators is not disclosed. The patent discloses the problem of power cross talk between resistors in two dimensional arrays of heater resistors. Voltages firing a resistor also apply partial voltages across unfired resistors. The parasitic voltage increases as the number of rows is increased to 5 rows. The patent applies partial voltages on certain lines to reduce the voltage cross talk. The partial energy does not eject a droplet, but maintains a common elevated temperature for both fired and unfired nozzles. The patent covers print head arrays having limited numbers of rows.

U.S. Pat. No. 5,548,311 to Hine, issued Aug. 20, 1996, entitled "Mount for replaceable ink jet head," discloses a piezoelectric drop-on-demand print head having a replaceable ink jet head. A set of nozzles selectively ejects ink when from electrical pulses are applied to transducers. The transducers are connected by wires to a series of spring contacts on the surface of the head that are electrically connected to a second set of contacts in a mobile carriage. The head structure uses connectors for each of 32 ink jets. The 32 contacts require 160 of clamping force to make a connection. A total of 400 grams of force needs to be applied at the connection to prevent disconnection due to g-forces when the carriage holding the head is translated during printing. It would be useful to reduce the complexity of the interconnection.

U.S. Pat. No. 4,791,440 to Eldridge et al., issued Dec. 13, 1988, entitled "Thermal drop-on-demand ink jet print head," discloses a structure for a DOD thermal inkjet head. A heater chip, nozzle plate and chip mount are combined to produce a pluggable unit which has both fluid and electrical connections. The patent describes the increase in cost and complexity of electrical fanout and electrical connection as the supporting electrical connections as nozzle count increases. The patent addresses those issues by organizing the heating means in multiple column and passing electrical connection through the substrate. Through connections are more complex and costly. The device has no internal semiconductor elements, and a dedicated connection is required for each heater. The author organizes the heating elements in two staggered rows on either side of tow large holes supplying a common As such, there is a need to provide a replaceable ink jet print head structure available at a reduced cost having a reduced number of semiconductor devices and electrical interconnections.

SUMMARY OF THE INVENTION

It is an object of this invention to provide low-cost replaceable head element. Another object of the invention is to provide tool-less replacablility of critical portions of an inkjet head.

According to one aspect of the present invention, a print head assembly is provided. The printhead includes a substrate including a plurality of electrical contacts and an array of ejectors arranged on the substrate. Each ejector includes a chamber including a nozzle. A resistive element is associated with the chamber and is operable to eject liquid from the chamber through the nozzle of the chamber when actuated through the plurality of electrical contacts. At least one supply passage through the substrate supplies fluid to each ejector. A printhead holder includes a structure to retain the printhead in a fixed position and a manifold to supply fluid to each ejector through the at least one supply passage. A removable frame has a first position and a second position relative to the printhead holder. The frame includes a plurality of electrical contacts that provide an electrical connection to the plurality of electrical contacts on the substrate of the printhead when the frame is in the first position, and permits removal of the printhead from the retaining structure of the printhead holder when the frame is in the second position.

According to another aspect of the present invention, a method of printing includes providing an original printhead comprising: a substrate including a plurality of electrical contacts; and an array of ejectors arranged on the substrate, each ejector comprising: a chamber including a nozzle; a resistive element associated with the chamber operable to eject liquid from the chamber through the nozzle of the chamber when actuated through the plurality of electrical contacts; and at least one supply passage through the substrate; a printhead holder including a structure to retain the printhead in a fixed position and a manifold to supply fluid to each ejector through the at least one supply passage; and a removable frame having a first position and a second position relative to the printhead holder, the frame including a plurality of electrical contacts that provide an electrical connection to the plurality of electrical contacts on the substrate of the printhead when the frame is in the first position, and permit removal of the printhead from the retaining structure of the printhead holder when the frame is in the second position; printing using the original printhead; moving the frame to the second position; replacing the original printhead with another printhead; and moving the frame to the first position.

DETAILED DESCRIPTION OF THE PREFERRED EMBODIMENT

Figure 1:
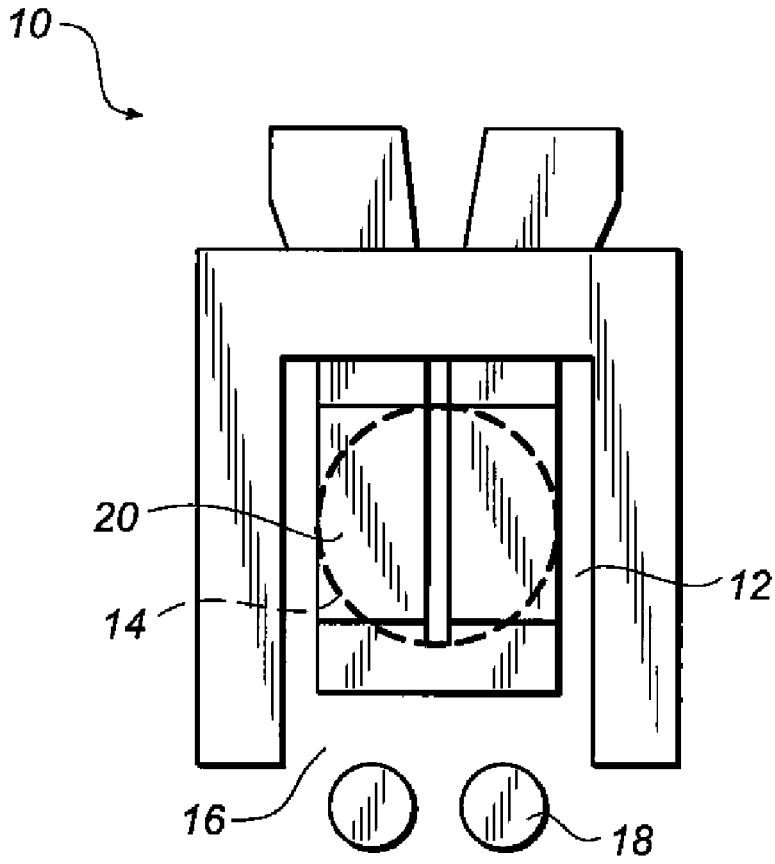
FIG. 1 is a top schematic view of an ejector in accordance with the present invention.
Figure 2:
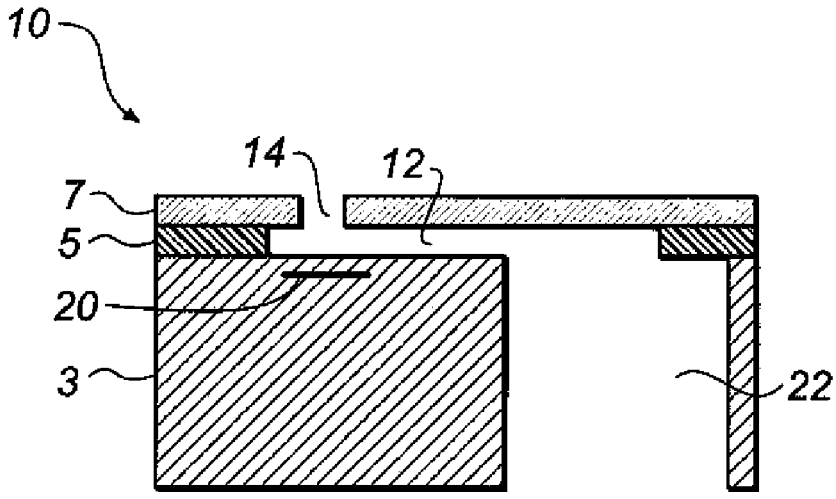
FIG. 2 is a side sectional view through the ejector shown in FIG. 1.

FIG. 1 is a top schematic view of an ejector 10 in accordance with the present invention. FIG. 2 is a side sectional view through the ejector shown in FIG. 1. A substrate 3 supports a polymer layer 5. Substrate 3 is most commonly a silicon wafer, however substrate 3 can be made of a glass or metal such as stainless steel, Invar, or nickel. An ink chamber 12 is formed as a cavity in polymer layer 5 to hold a printing ink. A cover 7 over ink chamber 12 can be formed directly over polymer layer 5 using a vacuum deposited ceramic or metal. Cover 7 over ink chamber 12 can also be a separate plate formed of ceramic or metal which is bonded to the polymer layer 5 defining ink chamber 12. Cover 7 has an opening to form a nozzle 14 to direct an ejected droplet of ink in a specified direction when ink chamber 12 is pressurized.

A heater resistor 20 is embedded in the substrate 3. A pulse of electrical energy to heater resistor 20 causes ink within ink chamber 12 to momentarily be converted into a gaseous state. A gas bubble is formed over heater resistor 20 within ink chamber 12, and pressurizes ink chamber 12. Pressure within ink chamber 12 acts on ink within ink chamber 12 and forces a droplet of ink to be ejected through nozzle 14. Inlet 16 supplies ink to ink chamber 12. Restriction 18 can be formed at inlet 16 to improve firing efficiency by restricting the majority of the pressure pulse to ink chamber 12. Restriction 18 can be in the form of one or more pillars formed within inlet 16, or by a narrowing of the sidewalls in polymer layer 5 at inlet 16 of ink chamber 12.

Resistive heads are commonly made using silicon for substrate 3. Heater resistor 20 and associated layers are formed over substrate 3, followed by polymer layer 5. Polymer layer 5 is patterned, followed by cover 7, which is patterned to form nozzle 14. After those layers have been formed, ink feed slot 22 is formed through substrate 3 using a reactive ion milling process. The reactive ion milling process has the characteristic of forming near-vertical walls through a silicon substrate 3. The ion milling process has the virtue that the process is specific to silicon and can form ink feed slot 22 without damage to structures associated with ejectors 10 on substrate 3. Substrate 3 is bonded to a structure which has one or more cavities 31 for supplying ink to some or all of ejectors 10 formed on substrate 3.

Figure 3:
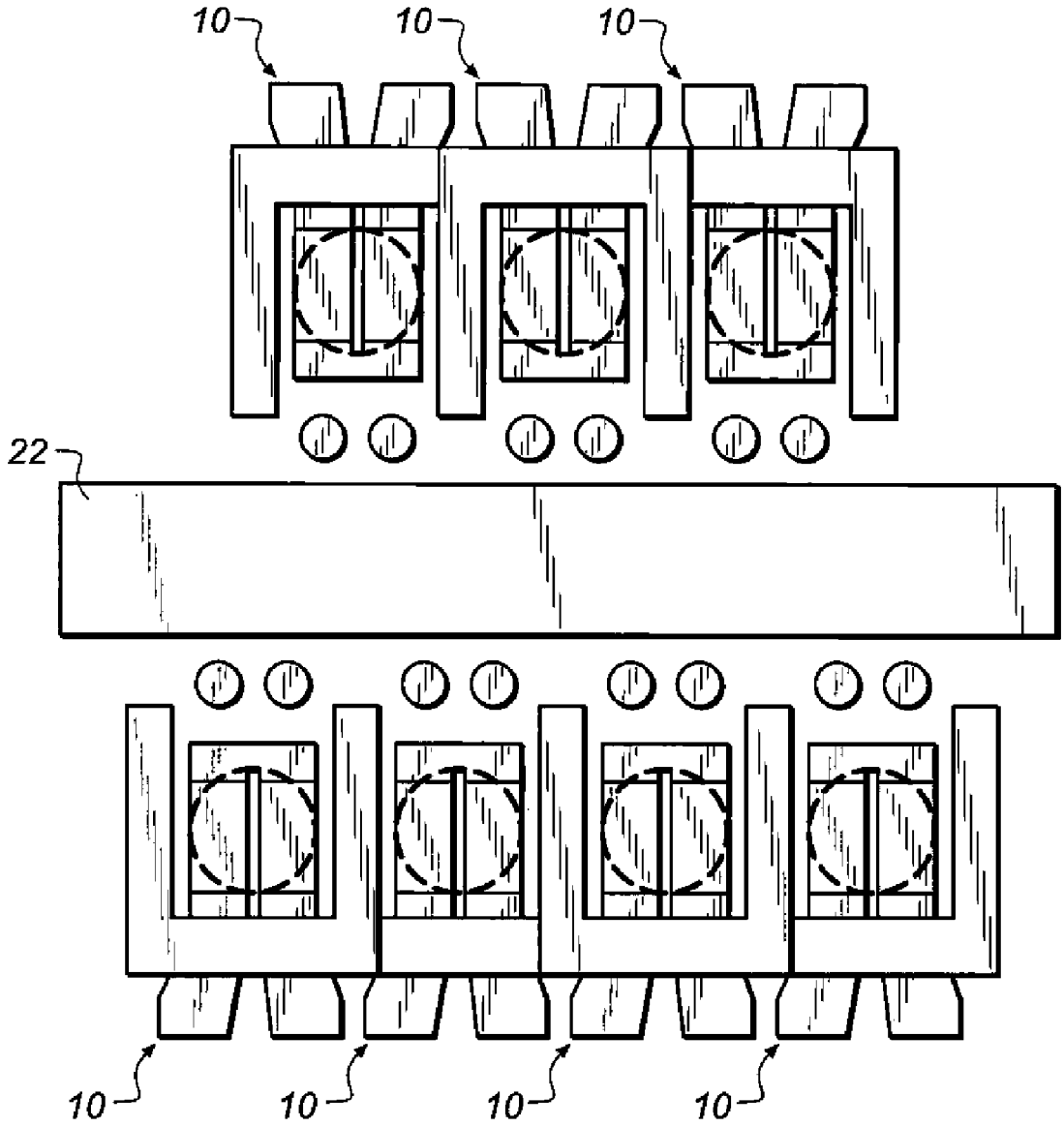
FIG. 3 (PRIOR ART)
FIG. 3 is a top view of an array of ink ejectors according to prior art.

FIG. 3 is a top view of an array of ink ejectors according to prior art. Ejectors 10 must be supplied by ink from the rear side of substrate 3. U.S. Pat. No. 6,722,759 describes a prior art thermal drop-on-demand printhead. Ejectors 10 are arranged in two closely packed rows that share a common ink feed slot 22. Ink feed slot 22 passes through substrate 3, which supports ejectors 10. Arranging two linear rows of ejectors 10 on either side of ink feed slot 22 provides for a compact ink jet head. Because the nozzles are adjacent to each other, fluidic cross-talk can occur between the ejectors. Close packing of the nozzles makes the head susceptible to thermal cross-talk between adjacent nozzles. Overheating can become more pronounced if substrate 3 is not silicon, but a less thermally conductive material such as glass, ceramic or metal.

Figure 4:
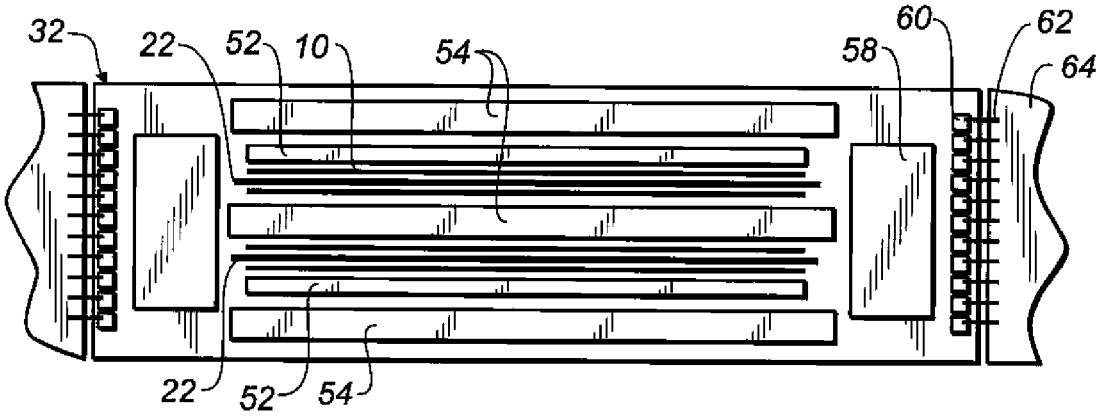
FIG. 4 is a top view of an inkjet print head assembly in accordance with prior art.

FIG. 4 is a top view of an inkjet print head in accordance with prior art. The recitation again generally follows the structures found in U.S. Pat. No. 6,722,759. A print head 32 has two ink feed slots 22, each feed slot feeding two rows of ejectors 10. A set of ejector drivers 52 is formed adjacent to each row of ejectors 10. Each ejector driver 52 is a semiconductor-switching elements that is attached to each heater resistor 20 within each ejector 10. The power requirements for thermal drop on demand inkjet are high, typically over 1 watt of power for approximately 1 microsecond. Ejector drivers 52 then are formed of PMOS or NMOS transistors to selectively apply power to heater resistors 20. Alternatively, ejector drivers 52 can be formed of thin-film-transistor elements having characteristics capable of meeting the power and switching times required to thermally eject a droplet from an ejector 10.

Power to ejector drivers 52 is provided by a conductor line 54 disposed one each side and down the center of substrate 3. Conductor lines 54 supply power and return for ejector drivers 52. Control logic 58 is disposed on both ends of the substrate 3 to decode data signals from printer controller 38 (not shown in figure). Data and power are delivered to control logic 58 through bond pads 60. Wire bonds 62 provide connection between bond pads 60 on substrate 3 and flex circuit 64. Data from controller 38 is delivered through flex circuit 64 through wire bonds 62 to control logic 58. Control logic 58 responds to control data from printer controller 38

Figure 5:
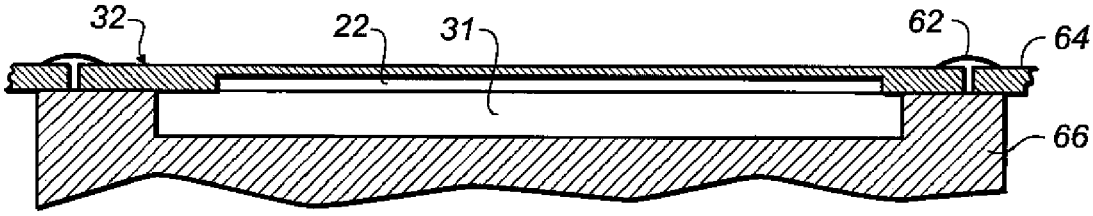
FIG. 5 is a side sectional view of the inkjet print head assembly shown in FIG. 4.

FIG. 5 is a side sectional view of the inkjet print head assembly shown in FIG. 4. In accordance with current art, print head 32 is bonded on head holder 66. Cavities 31 are formed in head holder 66 to provide ink to each ink feed slot 22 in print head 32. Flex circuit 64 is bonded to head holder 66 and wire bonds 62 are connected between flex circuit 64 and bond pads 60 formed over substrate 3.

Silicon based print heads 32 are built on a silicon wafer that is diced into a rectangular shape. The sawing process to cut out print heads 32 varies by 50 microns, creating variability in location of bond pads 60 relative to the edges of substrate 3. Bond pads 60 are small, typically 200 microns square, and require wire bonds 62 to connect to contacts areas on flex circuit 64. Because of the variability in dimension and accuracy requirements, print heads 32 are permanently bonded to head holder 66.

Figure 6:
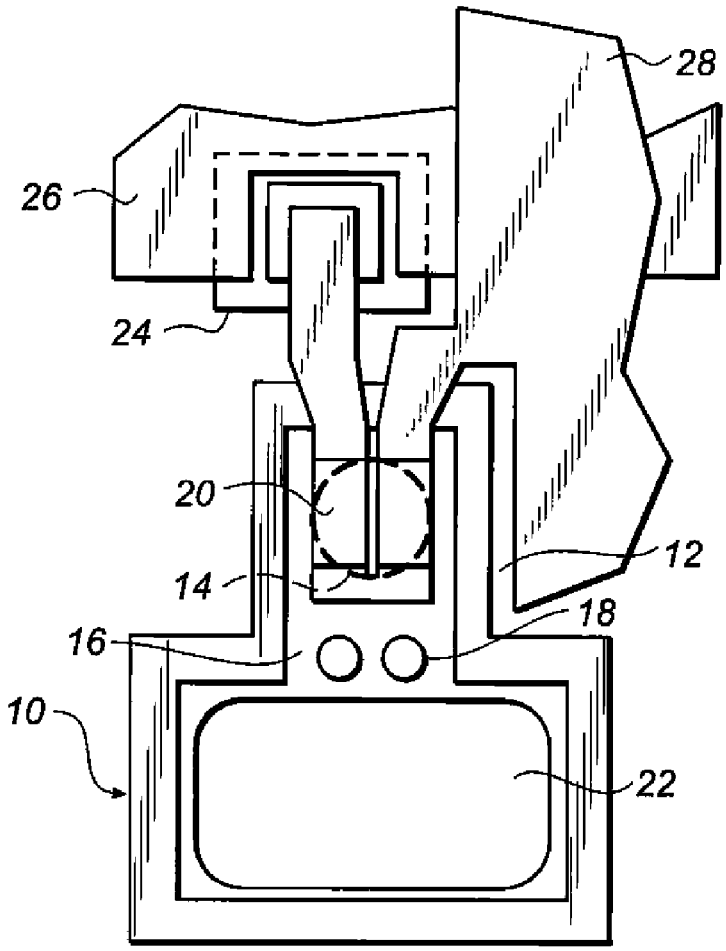
FIG. 6 is a top schematic view of an ejector in accordance with the present invention.

FIG. 6 is a top schematic view of an ejector in accordance with the present invention. In the invention, an ejector 10 comprises an ink chamber 12 actuated by heater resistor 20. Ink chamber 12 is fed by inlet 16 and ejects fluid through nozzle 14. A restriction 18 can be formed at the inlet to improve ejector 10's performance. A single ink feed slot 22 is dedicated to ejector 10. In the case that substrate 3 is made of silicon, the ability of reactive ion etching process to form substantially columnar individual supply passages 22 to be formed through substrate 3. Each ink feed slot 22 shares a common cavity 31 located at the back of substrate 3. Ejector 10 in accordance with the invention provides a complete assembly that can be positioned at greater distance from adjacent ejectors 10 to eliminate fluidic cross talk and improve cooling efficiency. In the case that substrate 3 is not silicon, the greater distance prevents overheating that would result from closely spaced ejectors 10 on lower conductivity substrates 3. Sufficient spacing between ejectors 10 further permits the use of anisotropic etching in non-silicon substrates.

U.S. Pat. No. 5,134,425 discloses a passive two-dimensional array of heater resistors. The patent discloses the problem of power cross talk between resistors in two-dimensional arrays of heater resistors. Voltages used to fire a given resistor apply partial voltages across unfired resistors, significantly increasing the current and power demand. In FIG. 6, ejector 10 is connected to row conductor 26 and column conductor 28. A diode 24 permits multiple ejectors 10 to be attached to a matrix of row conductors 26 and column conductors 28. The diodes block current flows to parasitic elements, reducing power demand of the device. The diodes permit large number of columns to be used on the head. The larger number of columns permits heads with finer resolution and greater spacing between ejectors 10.

Figure 7:
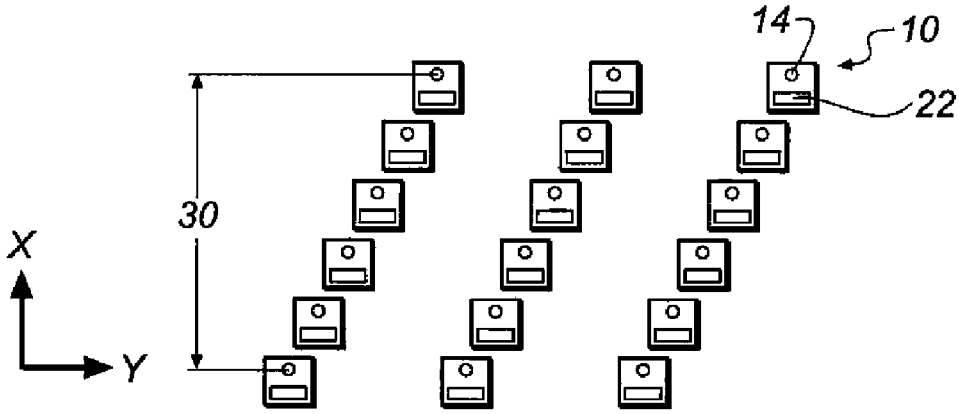
FIG. 7 is a schematic representation of an ejector array in accordance one example embodiment of the invention.

FIG. 7 is a schematic representation of an ejector array in accordance one example embodiment of the invention. A coordinate system is shown and includes a first direction X with X an axis of motion between the printhead and an ink-receiving surface. This is commonly referred to as a printing direction. A second direction Y is also shown with Y being a cross printing direction. A direction Z is also shown with Z being a direction perpendicular to the printhead. This is commonly referred to as the direction of ink drop ejection from the printhead.

Ejectors 10 are shown schematically as a box having individual supply ports 22 and ejectors 10. Ejectors 10 have been attached to a matrix of row conductors 26 and column conductors 28 to form laterally staggered columns of ejectors 10. Each ejector 10 of a column of ejectors is staggered at a desired pitch, typically expressed in dpi or microns, which is finer than the pitch of the ejector columns. For example, each column can be pitched 600 microns apart due to the area required for each ejector. If the required printing pitch is 40 microns, each ejector in the column can be laterally staggered 40 microns to a depth of 15 ejectors (40×15=600) to achieve the required 40 micron printing pitch.

The embodiments shown in FIGS. 6 and 7 are particularly well suited for print heads having large area arrays, for example, print heads having a length dimension of four inches and a width dimension of one inch. However, the large area array print head can have other length and width dimensions. One (or a plurality of large area array print heads stitched together) can be used to form a pagewide print head.

In a pagewide print head, the length of the printhead is preferably at least equal to the width of the receiver and does not "scan" during printing. The length of the page wide printhead is scalable depending on the specific application contemplated and, as such, can range from less than one inch to lengths exceeding twenty inches.

Figure 8:
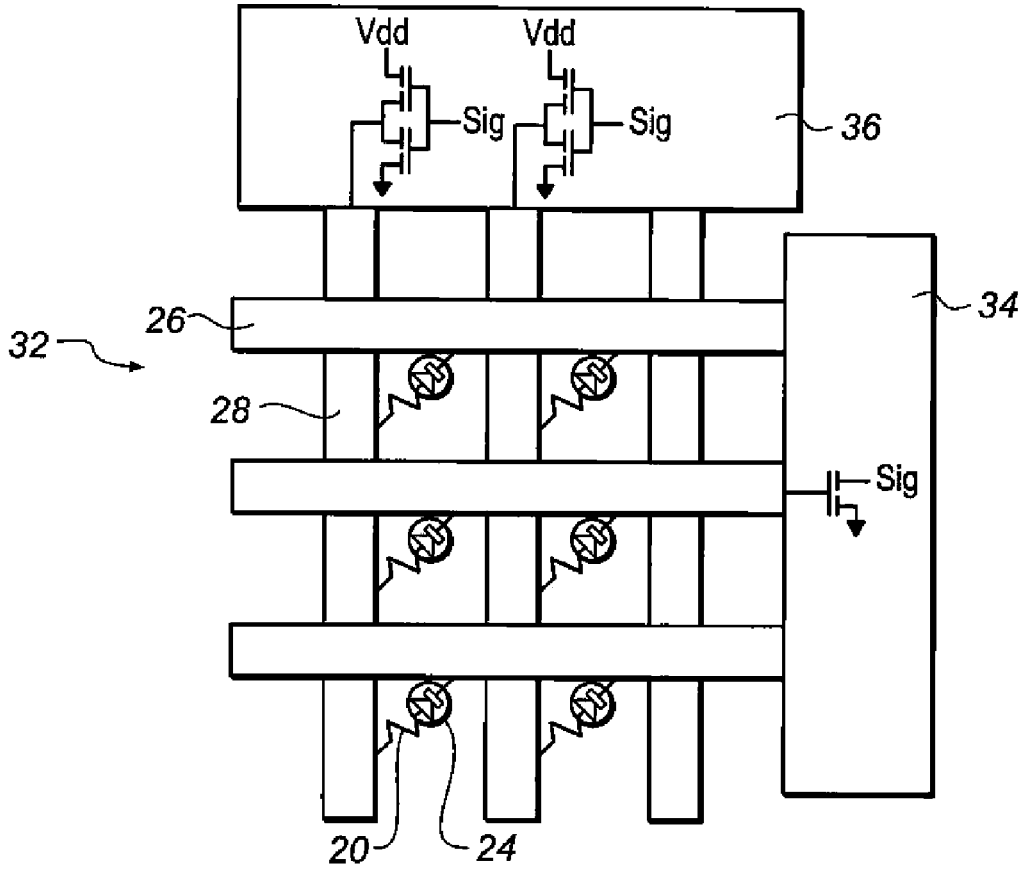
FIG. 8 is an electrical schematic of an ink jet head in accordance with the present invention.

FIG. 8 is an electrical schematic of an ink jet head in accordance with the present invention. Print head 32 has column conductors 28 connected to column driver 36. Column driver 36 can be a ST Microelectronics STV 7612 Plasma Display Panel Diver that is connected to column conductors 28. The chip responds to digital signals to either apply a drive voltage or ground to each column conductors. Each row conductor 26 is connected to a row driver 34. Row driver 34 can be a ST Microelectronics L6451 28 Channel Ink Jet Driver that provides a DMOS power transistor to each row conductor 26. Diode 24, provided with each ejector 10, provides logic to permit print head 32 to be logically driven in a sequential column wise fashion.

Print head 32 is fired row sequentially. Row driver 34 applies a ground voltage to a written row. Digital signals apply a drive voltage (Vdd) or ground voltage to each row conductor 26. Row conductors 26 having an applied drive voltage provide energy to the ejector attached to column conductor 28 and the grounded row conductor 26. Row conductors 26 having a ground voltage are not fired. Only one row conductor 26 at a time has a ground voltage, the other row conductors are attached to high impedance drivers and cannot fire. Row conductors 26 are fired in a sequential manner, and column conductors 28 are set to a state that corresponds to a row of ejectors being fired or not fired. After all rows have been written, all ejectors are fired and the process is repeated to apply an image wise pattern of ink droplets from print head 32.

Figure 9:
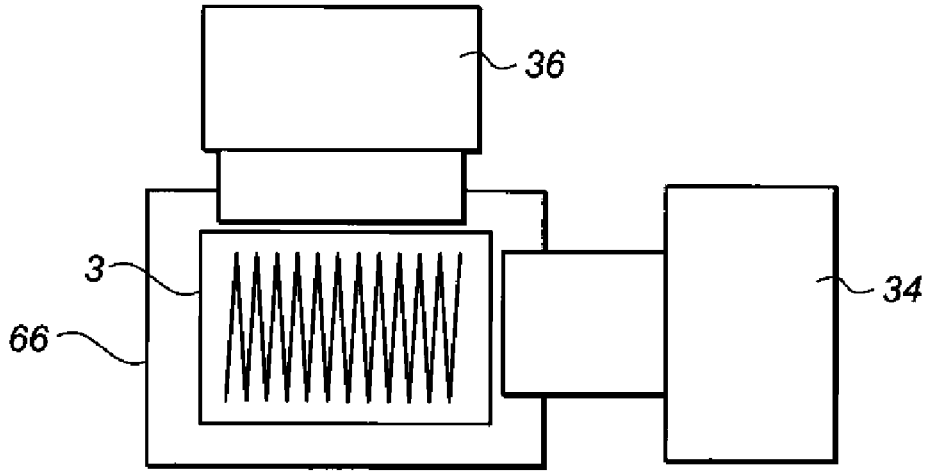
FIG. 9 is a schematic view of a head assembly in accordance with the present invention.

FIG. 9 is a schematic view of a head assembly in accordance with the present invention. Substrate 3 has been mounted to head holder 66 that provides a supply of ink behind substrate 3 to supply ink through individual ink feed slots 22 to each ejector on the front of substrate 3. Row driver 34 and column driver 36 are attached to head holder 66.

Figure 10:
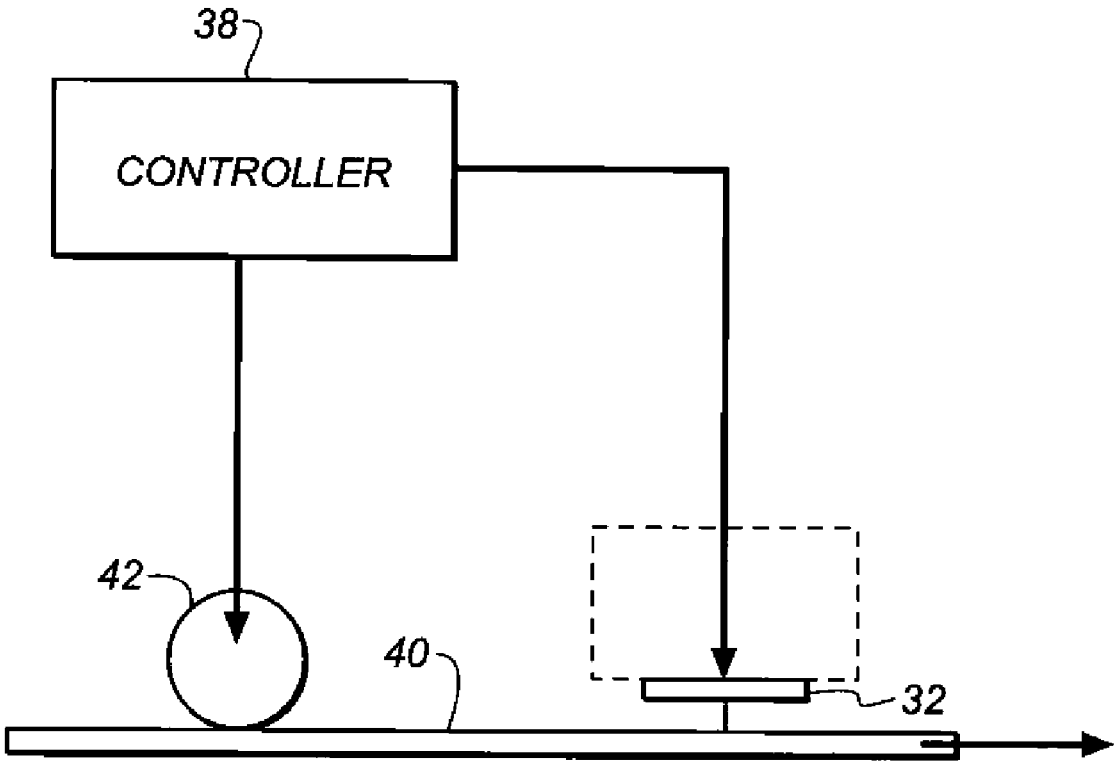
FIG. 10 is a side view of a printer using a head in accordance with the present invention.

FIG. 10 is a schematic side view of a printer using a head in accordance with the present invention. Printer controller 38 moves an ink receiver 40 using receiver driver 42. Receiver driver 42 is a motor that operates on a plate or roller to drive ink receiver 40 under print head 32. Printer controller 38 provides drive signals to row driver 34 and column driver 36 connected to print head 32 mounted on head holder 66 to apply an image-wise pattern of ink droplets onto ink receiver 40 in synchronization with the motion of ink receiver 40.

Figure 11:
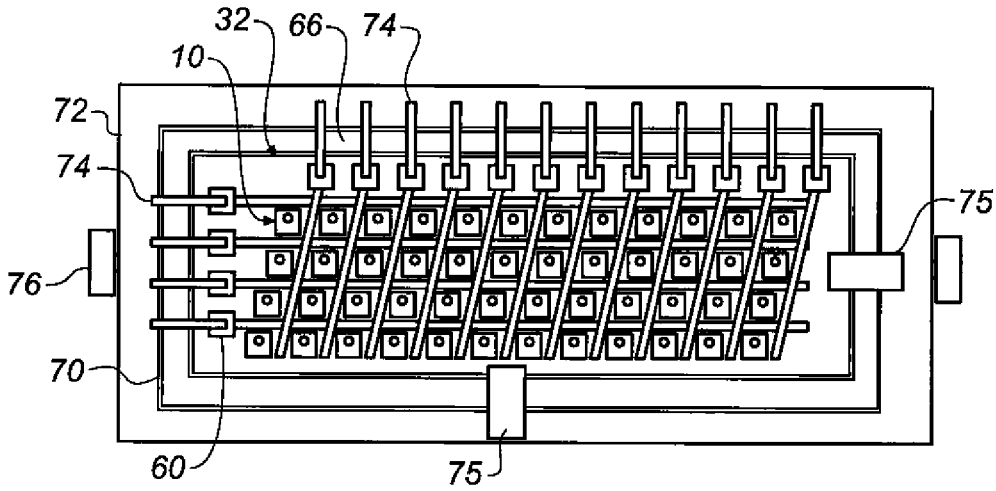
FIG. 11 is a top view of a head holder in accordance with the present invention.
Figure 12:
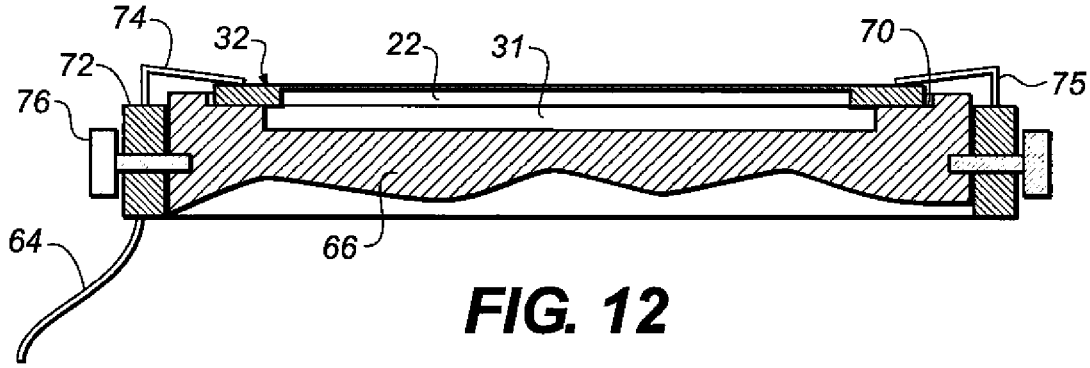
FIG. 12 is a side view of a head holder in accordance with the present invention.

FIG. 11 is a top view of a head holder 66 in accordance with the present invention. FIG. 12 is a side view of a head holder 66 in accordance with the present invention. In the invention, print head 32 is not bonded to head holder 66. Head holder 66 has a recess 70 to receive print head 32. Recess 70 is deep enough to provide a perimeter closely conforming to the perimeter of print head 32. If print head is 450 microns thick, recess 70 can have the same depth. In another embodiment, recess 70 can provide predefined point contacts to the perimeter of print head 32. Silicon print heads 32 made using semiconductor and MEMS processes will have flatness on the order of a few microns across the surface setting into the bottom of recess 70. The bottom of recess 70 should have equivalent flatness to provide a seal for inks in cavities 31 and ink feed slot 22. In the case of drop-on-demand heads, the ink is under less than 250 mm of water vacuum. The flatness of the two contacting surfaces on the bottom of recess 70 and the typical contact width of 1 mm are enough to provide a seal.

A holding frame 72 is aligned and can be selectively connected to head holder 66. In the example, holding frame 72 is a rectangular frame that aligns to the periphery of head holder 66. Securing pins 76 fit into details in head holder 66 to securely attach holding frame 72 to head holder 66. Head contacts 74 are secured to holding frame 72 and are formed to provide pressure contact to bond pads 60 when holding frame 72 is slide around the periphery of head holder 66 and securing pins 76 are locked into securing detail in head holder 66.

In the example, head contacts 74 are formed of gold plated beryllium-copper foil or wire, which have a bend that is flexed as holding frame 72 is secured to head holder 66. The bend provides a wiping action on bond pads 60, which provides reliable electrical connection during assembly. The gap between the ink-ejecting surface of print head 32 and an ink receiving substrate is small, typically 700 to 1,000 microns. Head contacts must fit into that space with enough clearance from the ink receiving substrate. Head contacts 74 can be formed of 75-micron thick beryllium-copper foil or wire and be bent nearly parallel to the ejecting surface of print head 32. Head contacts 74 can be designed to project can project a total of 200 microns into the space between the front of print head 32 and the ink receiving substrate. Additional, non-conductive contacts 75 can be provided around the periphery of holding frame 72 to provide sufficient and balanced pressure to hold print head 32 into recess 70.

Flex circuits 64 provide electrical connection to each head contact 74. Flex circuit 64 provides connection to row drivers 34 and column drivers 36 in the exemplary embodiment. Using the device structure of the examples, no control logic 58 is required; row drivers 34 and column drivers 36 provide those functions. The apparatus permits those components, as well as the manifold assembly to be reused. The life of ejectors 10 is limited, and the apparatus permits rapid, simple replacement of the ejectors without wasting other parts of the assembly.

Bond pads 60 and head contacts 74 must be must be large enough to compensate for tolerance errors in the assembled components. The fit between ink jet head and the perimeter of recess 70 requires 50 microns of clearance. The fit between head holder 66 and holding frame 72 requires another 50 microns of clearance. Head contacts can be manufactured to 75 micron accuracy. The contact area required for good electrical connection is 125 microns. In practice, bond pads need to be 300 microns square for the apparatus to work. That bond pad area is not significantly larger than the bond pads used in current devices. Arranging ejectors 10 into a row-column configuration with internal control logic in the form of diodes 24 minimizes the number of contacts required for a given number of ejectors 10 on a substrate.

Figure 13:
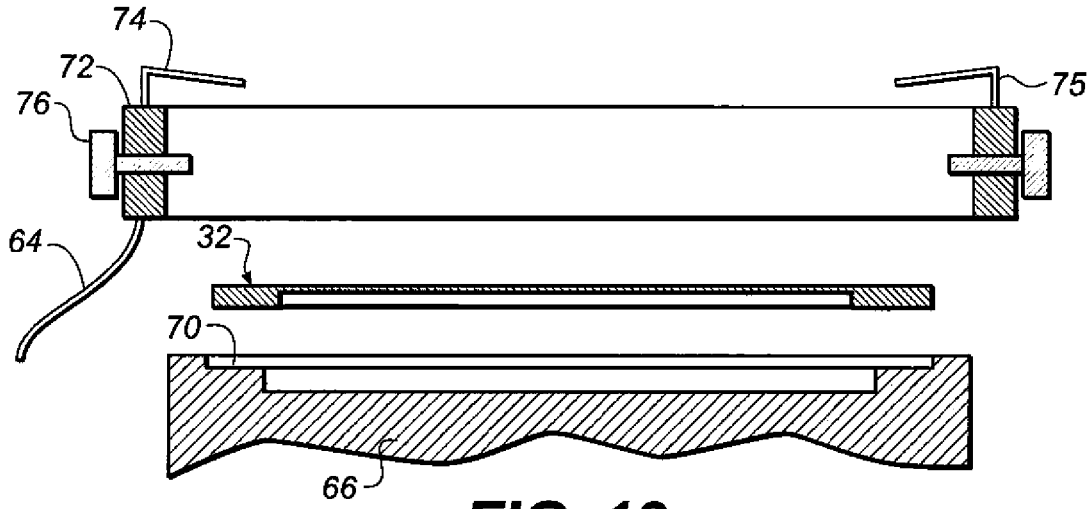
FIG. 13 is a side view of the disassembled invention.

FIG. 13 is a side view of the disassembled invention. Securing pins 76 have been disengaged from head holder 66, releasing holding frame 72 to move upwards and off of head holder 66. Flex circuit 64 permits holding frame 72 to be removed completely from the vicinity of head holder 66 to permit unhindered access to print head 32. With holding frame 72 removed, print head 32 can be lifted from recess 70 in head holder 66 and be replaced with another print head 32. Head contacts 74 move downward into their unloaded state position as holding frame 72 is removed. After a new print head 32 has been placed in recess 70, holding frame 72 can be slide back around head holder 66 and secured by securing pins 76. The action of positioning holding frame 72 back onto head holder 66 springs head contacts 74 nearly parallel to the front surface of print head 32, the ends of head contacts 74 wipe across the surface of bond pads 60. The presence of gold on the contact surface permits multiple head replacement with good electrical contact.

The invention has been described in detail with particular reference to certain preferred embodiments thereof, but it will be understood that variations and modifications can be effected within the scope of the invention.

| PARTS LIST | |
|---|---|
| 3 | substrate |
| 5 | polymer layer |
| 7 | cover |
| 10 | ejector |
| 12 | ink chamber |
| 14 | nozzle |
| 16 | inlet |
| 18 | restriction |
| 20 | heater resistor |
| 22 | ink feed slot |
| 24 | diode |
| 26 | row conductor |
| 28 | column conductor |
| 30 | spacing distance |
| 31 | cavities |
| 32 | print head |
| 34 | row drivers |
| 36 | column drivers |
| 38 | printer controller |
| 40 | ink receiver |
| 42 | receiver driver |
| 52 | ejector drivers |
| 54 | conductor lines |
| 58 | control logic |
| 60 | bond pads |
| 62 | wire bonds |
| 64 | flex circuit |
| 66 | head holder |
| 70 | recess |
| 72 | holding frame |
| 74 | head contacts |
| 75 | non-conductive contacts |
| 76 | securing pin |

What is claimed is:

1. A print head assembly comprising:

a printhead comprising:

a substrate including a plurality of electrical contacts; and an array of ejectors arranged on the substrate, each ejector comprising:

a chamber including a nozzle;

a resistive element associated with the chamber operable to eject liquid from the chamber through the nozzle of the chamber when actuated through the plurality of electrical contacts; and at least one supply passage through the substrate to supply fluid to each ejector;

a printhead holder including a structure to retain the printhead in a fixed position and a manifold to supply fluid to each ejector through the at least one supply passage; and a removable frame having a first position and a second position relative to the printhead holder, the frame including a plurality of electrical contacts that provide an electrical connection to the plurality of electrical contacts on the substrate of the printhead when the frame is in the first position, and permit removal of the printhead from the retaining structure of the printhead holder when the frame is in the second position.

2. The assembly of claim 1, the plurality of electrical contacts of the frame secure the printhead to the retaining structure of the printhead holder when the frame is in the first position.

3. The assembly of claim 1, wherein the retaining structure of the printhead holder is a recess located in the printhead holder.

4. The assembly of claim 1, wherein the array of ejectors arranged on the substrate includes a plurality of ejectors arranged on the substrate in rows and laterally staggered columns.

5. The assembly of claim 4, the printhead further comprising:

a plurality of row conductors arranged on the substrate and electrically connected to some of the substrate electrical contacts; and a plurality of column conductors arranged on the substrate and electrically connected to others of the substrate electrical contacts, wherein the resistive element of each ejector is electrically connected to one of the plurality of row conductors and one of the plurality of column conductors.

6. The assembly of claim 1, wherein the substrate electrical contacts are of sufficient size to permit electrical connection to the plurality of electrical contacts of the frame.

7. The assembly of claim 1, wherein the substrate electrical contacts and the frame electrical contacts are plated with a material permitting reliable electrical contact and corrosion resistance.

8. The assembly of claim 7, wherein the material is gold or an alloy thereof.

9. The assembly of claim 1, wherein a surface on the substrate of the printhead and a surface of the printhead holder are sufficient to create a fluidic seal when in contact with each other.

10. A method of printing comprising:

providing an original printhead comprising:

a substrate including a plurality of electrical contacts; and an array of ejectors arranged on the substrate, each ejector comprising:

a chamber including a nozzle;

a resistive element associated with the chamber operable to eject liquid from the chamber through the nozzle of the chamber when actuated through the plurality of electrical contacts; and at least one supply passage through the substrate;

a printhead holder including a structure to retain the printhead in a fixed position and a manifold to supply fluid to each ejector through the at least one supply passage; and a removable frame having a first position and a second position relative to the printhead holder, the frame including a plurality of electrical contacts that provide an electrical connection to the plurality of electrical contacts on the substrate of the printhead when the frame is in the first position, and permit removal of the printhead from the retaining structure of the printhead holder when the frame is in the second position;

printing using the original printhead;

moving the frame to the second position;

replacing the original printhead with another printhead; and moving the frame to the first position.

11. The method of claim 10, replacing the original printhead with another printhead includes removing the original printhead without using a tool.

* * * * *